US005575972A

United States Patent [19]

Mitsuhashi et al.

[11] Patent Number: 5,575,972

[45] Date of Patent: Nov. 19, 1996

[54] FE-CR ALLOY AND NOZZLE FOR DIESEL ENGINES

[75] Inventors: Akira Mitsuhashi; Takanori Matsui; Saburo Wakita, all of Omiya, Japan

[73] Assignees: Mitsubishi Materials Corporation; Mitsubishi Jidosha Kogyo Kabushiki Kaisha, both of Tokyo, Japan

[21] Appl. No.: 389,195

[22] Filed: Feb. 15, 1995

[30] Foreign Application Priority Data

Feb. 15, 1994 [JP] Japan ..... 6-040418
Feb. 15, 1994 [JP] Japan ..... 6-040419

[51] Int. Cl.[6] ..... C22C 38/26; F02B 19/16

[52] U.S. Cl. ..... 420/34; 420/37; 420/38; 420/39

[58] Field of Search ..... 420/34, 37, 38, 420/69

[56] References Cited

U.S. PATENT DOCUMENTS 2,848,323 8/1958 Harris et al. ..... 420/69

FOREIGN PATENT DOCUMENTS 1140573 3/1957 France .
3825634 2/1990 Germany .

OTHER PUBLICATIONS

Japan Patent Abstract, 3–115544, Precombustion Chamber Material For Cold And Warm Forgints Manufacture, May 16, 1991, Rikizo Watanabe.

Japan Patent Abstract, 56–96057, Cold And Warm Forgeable Ferrite Heat Resistant Steel For Inserting to Prechamber Of Diesel Engine, Aug. 3, 1981, Toshitaka Sugiuchi.

*Primary Examiner*—Sikyin Ip
*Attorney, Agent, or Firm*—Oblon, Spivak, McClelland, Maier & Neustadt, P.C.

[57] ABSTRACT

The present invention relates to a superior Fe—Cr alloy and a nozzle for diesel engines formed from this Fe—Cr alloy. The Fe—Cr alloy of the present invention comprises:

| | | | |
|---|---|---|---|
| C: | 0.1~0.2% by weight | Si: | 0.1~2% by weight |
| Mn: | 0.1~2% by weight | Cr: | 16~20% by weight |
| Mo: | 1.1~2.4% by weight | Nb: | 0.3~2.1% by weight |
| Ta: | 0.1~2.2% by weight | N: | 0.02~0.15% by weight |

with a remaining portion therein consisting of Fe and unavoidable impurities. It is possible to substitute a portion of the Fe using 0.2~2.5% by weight of Co. Furthermore, in this case, it is also possible to substitute a portion of the Fe using at least one element selected from among 0.2~2.5% by weight of Ni and 0.2~2.5% by weight of W.

20 Claims, 1 Drawing Sheet

FIGURE
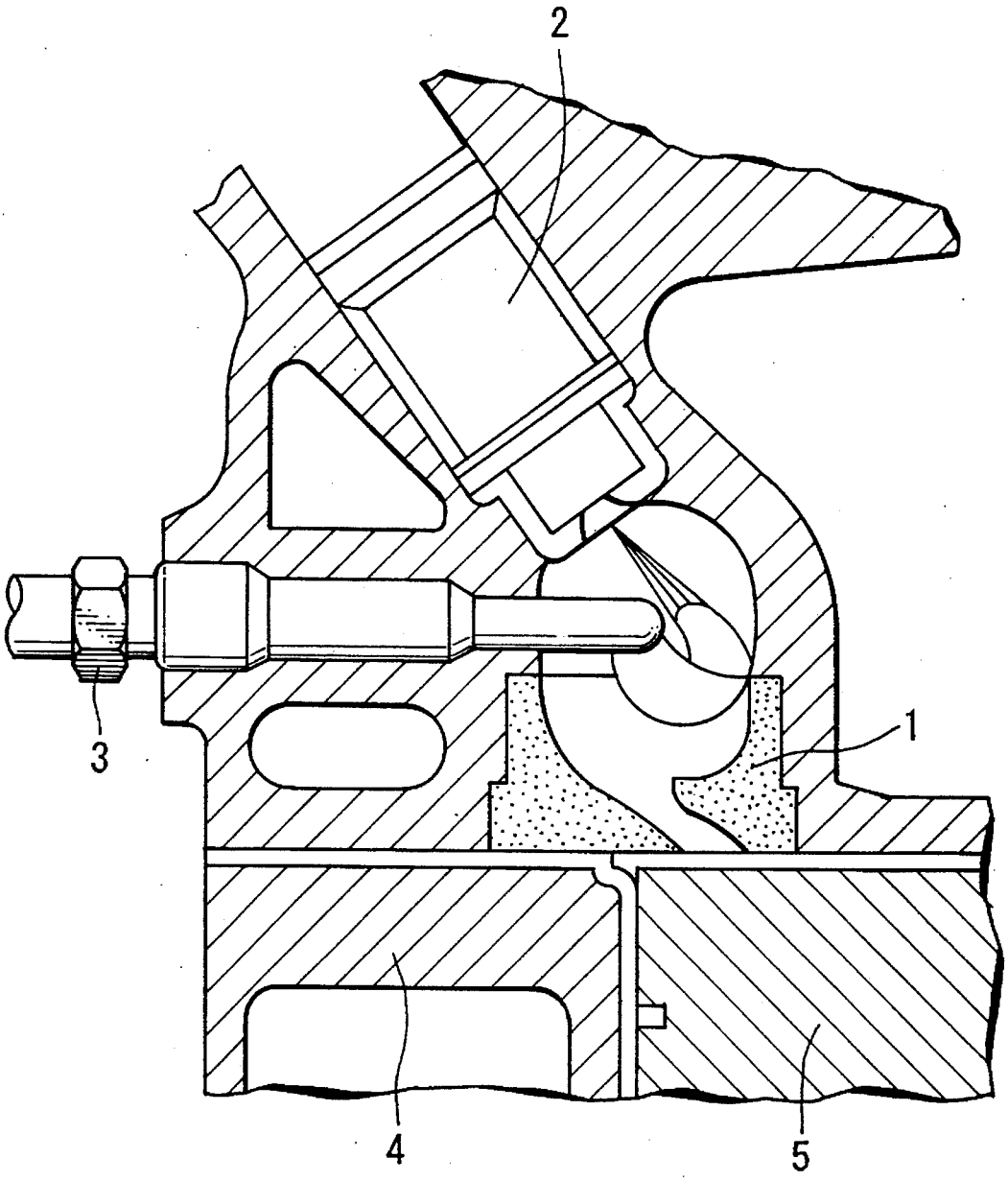

FE-CR ALLOY AND NOZZLE FOR DIESEL ENGINES

BACKGROUND OF THE INVENTION

1. Field of the Invention

The present invention relates to Fe—Cr alloy possessing superior high-temperature characteristics, in particular, a resistance to high-temperature deformation, thermal shock resistance, and high-temperature strength, and a nozzle forming a sub-combustion :chamber nozzle of diesel engines.

2. Background Art

The figure is a longitudinal cross sectional diagram showing a structural outline of a standard diesel engine. According to this type of diesel engine, conventionally, fuel is injected into the sub-combustion chamber from the injection nozzle 2, and this fuel is then ignited by means of spark plug 3. The ignited fuel is then supplied to the combustion chamber formed by means of cylinder block 4 and piston 5 :via nozzle 1 forming the sub-combustion chamber.

Nozzle 1 is formed by means of a forging-worked member of, for example, Fe—Cr alloy and the like. Examples of this type of nozzle can be found by referencing Japanese Patent Application, First Publication, No. Sho 56-96057 and Japanese Patent Application, First Publication, No. Hei 3-115544.

In recent years, there has been a growing demand for high performance and high output diesel engines. Accompanying these demands, the Usage environment of the nozzle forming the nozzle portion of the sub-combustion chamber in the above-mentioned diesel engine has become increasingly strict, as a tendency exists for exposure to environments of even higher temperatures. However, due to the insufficient high-temperature characteristics, in particular, resistance to high-temperature deformation, thermal shock resistance, and high-temperature strength of the nozzle formed by means of conventional Fe—Cr alloys, under severe temperatures greater than conventionally observed, disadvantages exist in that deformation and cracking easily occur and the service life is reached in a comparatively short time.

SUMMARY OF THE INVENTION

In consideration of the aforementioned, the inventors of the present invention have conducted intensive research in order to develop an Fe—Cr alloy possessing even superior high-temperature characteristics and nozzle for use in diesel engines. As a result, the present invention was achieved based on this above-mentioned research. It is, therefore, an object of the present invention to provide a nozzle for use in diesel engines comprising a Fe—Cr heat resistant cast metal alloy possessing the following composition:

| | | | |
|---|---|---|---|
| C: | 0.1~0.2% by weight | Si: | 0.1~2% by weight |
| Mn: | 0.1~2% by weight | Cr: | 16~20% by weight |
| Mo: | 1.1~2.4% by weight | Nb: | 0.3~2.1% by weight |
| Ta: | 0.1~2.2% by weight | N: | 0.02~0.15% by weight |

with a remaining portion therein consisting of Fe and unavoidable impurities (in the aforementioned, "%" indicates percent by weight). This nozzle for use in diesel engines exhibits high-temperature characteristics superior to those of the conventional product; in other words, the nozzle for use in diesel engines according to the present invention exhibits superior a resistance to high-temperature deformation, thermal shock resistance, and high-temperature strength, and can sufficiently withstand usage in high-temperature environments even more severe than conventionally observed. In the following, the reasons for restricting the composition of the ideal Fe—Cr alloy, as the cast metal material of the nozzle, to the aforementioned will be explained.

(a) Carbon (C)

The carbon component contributes to improvement of castability, and increasing the high-temperature strength and resistance to high-temperature deformation by means of forming a carbide. However, when the content of the aforementioned is less than 0.1%, the aforementioned effects (i.e., improvement of the castability and increase of high-temperature strength and resistance to high-temperature deformation) are insufficient; while on the other hand, a carbon content exceeding 0.2% results in a drastic reduction of the thermal shock resistance. Therefore, the carbon (C) content is specified as 0.1~0.2%.

(b) Silicon (Si)

The Si component is an indispensable component in the deoxidation of the melt, and in imparting of casting properties. In order to sufficiently generate the aforementioned effects, a Si component content of at least 0.1% is required. On the other hand, when this content exceeds 2%, the resistance to oxidation is reduced, hence this content is specified as 0.1~2%. When Co is not included in the alloy composition, the Si content is preferably 0.4~1.2%. Furthermore, a Si content of 0.5~0.9% is even more preferable, regardless of whether or not Co is included.

(c) Manganese (Mn)

In addition to contributing to deoxidation action similar to the Si component, the Mn component improves the toughness at room temperature by dissolving into the matrix (substrate). When the Mn content is less than 0.1%, it is not possible to sufficiently generate the aforementioned effects; on the other hand, when the aforementioned content exceeds 2%, the resistance to oxidation is reduced, hence, the Mn content is specified as 0.1~2%. In the case when Co is not included in the alloy composition, the Mn content is preferably 0.2~1%. Furthermore, Mn content of 0.3~0.7% is more preferable regardless of whether Or not Co is included.

(d) Chromium (Cr)

The Cr component drastically improves the high-temperature oxidation resistance. However, when the Cr content is less than 16%, the desired effects of improving the high-temperature oxidation resistance cannot be obtained; on the other hand, when this aforementioned content exceeds 20%, rapid embrittlement is observed. Therefore, the content of the Cr component is specified as 1.6~20%.

(e) Molybdenum (Mo)

The Mo component improves the high-temperature strength, resistance to high-temperature deformation and thermal shock resistance by dissolving into the substrate (matrix). However, when the Mo content is less than 1.1%, the aforementioned desired effects cannot be achieved; on the other hand, when this content exceeds 2.4%, the thermal shock resistance is reduced. Therefore, the content of the Mo component is specified as 1.1~2.4%, and preferably 1.6~2.2%.

(f) Niobium (Nb) and Tantalum (Ta)

These components, in a state of coexistence, contribute towards improving the high-temperature strength, resistance to high-temperature deformation, and thermal shock resistance by forming carbides. In other words, in the case when Ta is added alone, the high-temperature strength, resistance to high-temperature deformation, and thermal shock resistance are improved due to the essential formation of carbides in the alloy. However, in the case when Ta coexists with Nb, these aforementioned effects exhibit even greater improvements. Furthermore, a portion of the Ta dissolves into the matrix thereby increasing the fineness and adhesion of the oxide film formed mainly by means of Cr. This, in turn, imparts the effects of improving the resistance to high-temperature oxidation of the alloy. Consequently, when either Nb or Ta is less than 0.3% (Nb) or 0.1% (Ta), the above-described actions are insufficient and the desired effects are unobtainable. On the other hand, if either of these amounts exceeds 2.1% (Nb) or 2.2% (Ta), the resistance to high-temperature deformation is reduced. Therefore, the content of the Nb component is specified as 0.3~2.1%, and preferably 1.2~1.9%; and the content of the Ta component is specified as 0.1~2.2%, and preferably 0.2~1.0%.

(g) Nitrogen (N)

The N component improves the high-temperature strength and resistance to high-temperature deformation, by forming a nitride. However, these desired results cannot be obtained when the content of the N component is less than 0.02%; on the other hand, when this content exceeds 0.15%, the thermal shock resistance is drastically reduced. Therefore, the content of the N component is specified as 0.02~0.15%, preferably 0.05~0.15%, and more preferably 0.06~0.12%. Furthermore, in the Fe—Cr alloys formed from the above-described compositions, it is possible to substitute a portion of the Fe with 0.2~2.5% Co. This Co Component improves the high-temperature strength and resistance to high-temperature deformation by dissolving into the matrix. However, when the content of Co component is less than 0.2%, sufficient effects cannot be displayed; on the other hand, a Co content exceeding 2.5% results in a reduction of the aforementioned effects. Therefore, in the case when Co is added, the content therein is specified as 0.2 ~2.5%, and preferably 0.4~1.8%.

In addition, regardless of Whether or not Co is added, a portion of the Fe may be substituted by means of 0.2~2.5% of Ni and/or 0.2~2.5% of W. Both the Ni and W components serve to further improve the the high-temperature strength and resistance to high-temperature deformation by means of dissolving into the matrix.

However, when the contents of Ni and W are less than Ni: 0.2% and W: 0.2%, respectively, the above-described effects are insufficient. On the other hand, when these contents exceed Ni: 2.5% and W: 2.5%, respectively, the thermal shock resistance is reduced. Therefore, the contents of Ni and W are specified as Ni: 0.2%~2.5%, preferably 0.4~1.8%, and W: 0.2%~2.5%, preferably 0.3~1.7%.

Furthermore, use of the Fe—Cr alloy of the present invention is not limited to the above nozzle for diesel engines, and can also be applied to heat resistant members requiring superior high-temperature characteristics similar to those of the aforementioned nozzle.

BRIEF DESCRIPTION OF THE DRAWINGS

The Figure is a longitudinal cross sectional diagram showing a standard diesel engine.

DETAILED DESCRIPTION OF THE INVENTION

In the following, the effects of the Fe—Cr alloys and nozzles according to the present invention will be described in detail using Experimental Examples.

EXPERIMENTAL EXAMPLE 1

Fe—Cr alloy melts formed from the compositions shown in Tables 1 and 2 were respectively formed in atmospheric air using a standard high frequency induction melting furnace. The nozzles 1~15 of the present invention, comparative nozzles 1~10, and samples for testing high-temperature tensile strength in order to evaluated high-temperature strength were then cast by means of pouring each of the aforementioned melts into cast molds using a lost-wax method. All of the nozzles possessed the same shape as shown in the Figure. The dimensions of all members were (upper end outer diameter: 30 mm) × (upper end inner diameter: 25 mm) × (height: 20 mm). The samples for testing high-temperature tensile strength were round bars possessing the dimensions of (diameter: 12 mm) × (length: 80 mm).

Furthermore, the comparative nozzles 1~10 were formed by means of Fe—Cr alloys possessing compositions in which the content of one component, among all components exerting influence on the high-temperature strength, resistance to high-temperature deformation, and thermal shock resistance, was outside of the range specified in the present invention.

After installing each of the aforementioned nozzles into a 2,000 cc (exhaust amount) diesel engine, actual mechanical tests were conducted under severe conditions by performing 2,000 cycles on each nozzle in which one cycle included a two minute stoppage after running the engine at 5,500 rpm for 5 minutes. Following completion of the above test, the nozzle was removed and the maximum distortion amount (maximum projection amount) at the bottom face nozzle portion of the nozzle was measured by means of a surface roughness tester in older to evaluate the resistance to high-temperature deformation. In addition, in order to evaluate the thermal shock resistance, the maximum length (maximum crack length) of crack(s) generated in the bottom face nozzle portion of the nozzle was measured. The results of these measurements are shown in Table 3. Furthermore, the high-temperature tensile strengths measured by means of a high-temperature tensile test of 800° C. are similarly shown in Table 3.

As seen from the results shown in Tables 1~3, nozzles 1~15 of the present invention each displayed superior characteristics with regard to high-temperature strength, resistance to high-temperature deformation, and thermal shock resistance. On the other hand, in the case of comparative nozzles 1—10 in which the content of one component comprising the Fe—Cr alloy was outside of the range specified according to the present invention, the aforementioned change resulted in the occurrence of one inferior characteristic among the high-temperature strength, resistance to high-temperature deformation, and thermal shock resistance.

TABLE 1

| Classification | Component Composition (% by weight) | | | | | | | | |
|---|---|---|---|---|---|---|---|---|---|
| | C | Si | Mn | Cr | Mo | Nb | Ta | N | Fe + Impurities |
| Nozzles of the Present Invention | | | | | | | | | |
| 1 | 0.15 | 0.70 | 0.48 | 18.1 | 1.90 | 1.31 | 1.22 | 0.080 | Remainder |
| 2 | 0.16 | 0.42 | 0.53 | 18.3 | 1.86 | 1.33 | 1.08 | 0.090 | Remainder |
| 3 | 0.16 | 1.19 | 0.50 | 17.9 | 1.91 | 1.31 | 1.07 | 0.089 | Remainder |
| 4 | 0.14 | 0.81 | 0.21 | 18.0 | 1.94 | 1.35 | 1.23 | 0.078 | Remainder |
| 5 | 0.15 | 0.79 | 0.97 | 18.2 | 1.94 | 1.36 | 1.25 | 0.081 | Remainder |
| 6 | 0.15 | 0.72 | 0.55 | 16.1 | 1.91 | 1.29 | 1.27 | 0.087 | Remainder |
| 7 | 0.15 | 0.74 | 0.53 | 19.8 | 1.89 | 1.27 | 1.26 | 0.090 | Remainder |
| 8 | 0.17 | 0.69 | 0.57 | 18.4 | 1.12 | 1.34 | 1.18 | 0.079 | Remainder |
| 9 | 0.14 | 0.71 | 0.58 | 18.1 | 2.38 | 1.33 | 1.20 | 0.083 | Remainder |
| 10 | 0.15 | 0.72 | 0.59 | 17.8 | 1.88 | 0.32 | 1.25 | 0.081 | Remainder |
| 11 | 0.15 | 0.73 | 0.60 | 18.0 | 1.90 | 2.06 | 1.24 | 0.083 | Remainder |
| 12 | 0.18 | 0.70 | 0.49 | 17.9 | 2.01 | 1.30 | 0.12 | 0.085 | Remainder |

TABLE 2

| Classification | Component Composition (% by weight) | | | | | | | | |
|---|---|---|---|---|---|---|---|---|---|
| | C | Si | Mn | Cr | Mo | Nb | Ta | N | Fe + Impurities |
| Nozzles of the Present Invention | | | | | | | | | |
| 13 | 0.17 | 0.69 | 0.50 | 18.1 | 2.05 | 1.29 | 2.16 | 0.091 | Remainder |
| 14 | 0.15 | 0.73 | 0.53 | 18.3 | 1.87 | 1.32 | 1.19 | 0.052 | Remainder |
| 15 | 0.15 | 0.74 | 0.52 | 18.4 | 1.89 | 1.34 | 1.21 | 0.147 | Remainder |
| Comparative Nozzles | | | | | | | | | |
| 1 | 0.04* | 0.71 | 0.49 | 18.2 | 1.88 | 1.30 | 1.24 | 0.083 | Remainder |
| 2 | 0.27* | 0.69 | 0.50 | 18.3 | 1.89 | 1.31 | 1.25 | 0.084 | Remainder |
| 3 | 0.16 | 0.70 | 0.56 | 18.7 | 0.74* | 1.32 | 1.22 | 0.076 | Remainder |
| 4 | 0.15 | 0.71 | 0.55 | 18.0 | 2.83* | 1.32 | 1.24 | 0.079 | Remainder |
| 5 | 0.15 | 0.72 | 0.60 | 18.1 | 1.92 | 1.16* | 1.26 | 0.080 | Remainder |
| 6 | 0.15 | 0.71 | 0.61 | 18.2 | 1.87 | 2.44* | 1.28 | 0.081 | Remainder |
| 7 | 0.17 | 0.69 | 0.51 | 17.8 | 1.99 | 1.28 | 0.03* | 0.084 | Remainder |
| 8 | 0.16 | 0.71 | 0.49 | 18.0 | 2.02 | 1.27 | 2.65* | 0.089 | Remainder |
| 9 | 0.15 | 0.72 | 0.51 | 18.2 | 1.89 | 1.30 | 1.21 | 0.023* | Remainder |
| 10 | 0.14 | 0.73 | 0.53 | 18.5 | 1.92 | 1.32 | 1.23 | 0.196* | Remainder |

(Note: *indicates values outside the range of the present invention)

TABLE 3

| Classification | High Temperature Tensile Strength (kgf/mm$^2$) | Maximum Deformation (mm) | Maximum Crack Length (mm) | Classification | High Temperature Tensile Strength (kgf/mm$^2$) | Maximum Deformation (mm) | Maximum Crack Length (mm) |
|---|---|---|---|---|---|---|---|
| Nozzles of the Present Invention | | | | Nozzles of the Present Invention | | | |
| 1 | 7.32 | 0.04 | 0.3 | 13 | 7.82 | 0.02 | 0.7 |
| 2 | 7.15 | 0.05 | 0.4 | 14 | 6.85 | 0.08 | 0.5 |
| 3 | 7.60 | 0.04 | 0.9 | 15 | 7.92 | 0.02 | 0.8 |
| 4 | 7.13 | 0.06 | 0.5 | Comparative Nozzles | | | |
| 5 | 7.48 | 0.05 | 0.8 | | | | |
| 6 | 7.35 | 0.04 | 0.4 | 1 | 6.21 | 0.23 | 1.2 |
| 7 | 7.20 | 0.05 | 0.9 | 2 | 8.43 | 0.06 | 2.3 |
| 8 | 6.33 | 0.08 | 0.5 | 3 | 6.01 | 0.28 | 1.5 |
| 9 | 7.82 | 0.03 | 0.7 | 4 | 8.24 | 0.04 | 2.7 |

TABLE 3-continued

| Classification | High Temperature Tensile Strength (kgf/mm²) | Maximum Deformation (mm) | Maximum Crack Length (mm) | Classification | High Temperature Tensile Strength (kgf/mm²) | Maximum Deformation (mm) | Maximum Crack Length (mm) |
|---|---|---|---|---|---|---|---|
| 10 | 6.21 | 0.10 | 0.6 | 5 | 5.85 | 0.34 | 1.3 |
| 11 | 7.94 | 0.02 | 0.8 | 6 | 8.33 | 0.03 | 3.0 |
| 12 | 6.43 | 0.09 | 0.6 | 7 | 6.09 | 0.30 | 1.0 |
| | | | | 8 | 8.26 | 0.03 | 2.6 |
| | | | | 9 | 6.31 | 0.21 | 0.6 |
| | | | | 10 | 8.14 | 0.02 | 2.9 |

EXPERIMENTAL EXAMPLE 2

Fe—Cr alloy melts formed from the compositions shown in Tables 4~6 were respectively formed according to the same method as in Experimental Example 1. The nozzles 16~39 of the present invention, comparative nozzles 11~22, and samples for testing high-temperature tensile strength, in order to evaluated high-temperature strength, were then cast by means of pouring each of the aforementioned melts into cast molds using a lost-wax method. The dimensions of the nozzles and samples for testing high-temperature tensile strength were identical to those of Experimental Example 1.

Furthermore, the comparative nozzles 11~22 were formed by means of Fe—Cr alloys possessing compositions in which the content of one component, among all component exerting influence on the high-temperature strength, resistance to high-temperature deformation, and thermal shock resistance, was outside of the range specified in the present invention.

After installing each of the aforementioned nozzles into a 2,000 cc (exhaust amount) diesel engine, actual mechanical tests were conducted under severe conditions by performing 2,500 cycles on each nozzle in which one cycle included a five minute stoppage after running the engine at 6,000 rpm for 5 minutes. Following completion of the aforementioned test, the nozzle was removed and the maximum distortion amount (maximum projection amount) at the bottom face nozzle portion of the nozzle was measured by means of a surface roughness tester in order to evaluate the resistance to high-temperature deformation. In addition, in order to evaluate the thermal shock resistance, the maximum crack length of the bottom face nozzle portion of the nozzle was measured. The results of these measurements are shown in Tables 7 and 8. Furthermore, the high-temperature tensile strengths measured by means of a high-temperature tensile test of 850° C. are shown in the same Tables.

As seen from the results shown in Tables 4~8, nozzles 16~39 of the present invention each displayed superior characteristics with regard to high-temperature strength, resistance to high-temperature deformation, and thermal shock resistance. On the other hand, in the case of comparative nozzles 11~22 in which the content of one component comprising the Fe—Cr alloy was outside of the range specified according to the present invention, the aforementioned change resulted in the occurrence of one inferior characteristic among the high-temperature strength, resistance to high-temperature deformation, and thermal shock resistance.

TABLE 4

| Classification | Component Composition (% by weight) | | | | | | | | | | | |
|---|---|---|---|---|---|---|---|---|---|---|---|---|
| | C | Si | Mn | Cr | Mo | Nb | Ta | Co | N | Ni | W | Fe + Impurities |
| Nozzles of the Present Invention | | | | | | | | | | | | |
| 16 | 0.16 | 0.72 | 0.42 | 18.3 | 2.01 | 1.33 | 1.21 | 1.55 | 0.077 | — | — | Remainder |
| 17 | 0.19 | 0.12 | 0.45 | 18.4 | 1.98 | 1.29 | 1.19 | 1.60 | 0.079 | — | — | Remainder |
| 18 | 0.11 | 1.94 | 0.46 | 18.2 | 1.97 | 1.32 | 1.23 | 1.62 | 0.083 | — | — | Remainder |
| 19 | 0.18 | 0.75 | 0.22 | 17.9 | 2.05 | 1.25 | 1.24 | 1.63 | 0.085 | — | — | Remainder |
| 20 | 0.13 | 0.73 | 0.98 | 17.7 | 2.01 | 1.23 | 1.25 | 1.65 | 0.081 | — | — | Remainder |
| 21 | 0.15 | 0.69 | 0.48 | 16.4 | 1.89 | 1.26 | 1.17 | 1.68 | 0.08 | — | — | Remainder |
| 22 | 0.17 | 0.71 | 0.45 | 19.7 | 1.86 | 1.23 | 1.15 | 1.70 | 0.079 | — | — | Remainder |
| 23 | 0.13 | 0.72 | 0.50 | 18.3 | 1.11 | 1.27 | 1.18 | 1.73 | 0.080 | — | — | Remainder |
| 24 | 0.18 | 0.70 | 0.49 | 18.1 | 2.39 | 1.29 | 1.16 | 1.69 | 0.083 | — | — | Remainder |
| 25 | 0.16 | 0.75 | 0.51 | 18.0 | 1.82 | 0.31 | 1.19 | 1.62 | 0.085 | — | — | Remainder |
| 26 | 0.14 | 0.74 | 0.52 | 18.2 | 1.85 | 2.06 | 1.21 | 1.60 | 0.088 | — | — | Remainder |
| 27 | 0.16 | 0.71 | 0.48 | 18.5 | 1.99 | 1.30 | 0.12 | 1.62 | 0.079 | — | — | Remainder |

TABLE 5

| Classification | Component Composition (% by weight) | | | | | | | | | | | |
|---|---|---|---|---|---|---|---|---|---|---|---|---|
| | C | Si | Mn | Cr | Mo | Nb | Ta | Co | N | Ni | W | Fe + Impurities |
| Nozzles of the Present Invention | | | | | | | | | | | | |
| 28 | 0.15 | 0.73 | 0.50 | 18.7 | 2.01 | 1.29 | 2.17 | 1.64 | 0.082 | — | — | Remainder |
| 29 | 0.13 | 0.69 | 0.53 | 18.8 | 1.93 | 1.28 | 1.20 | 0.21 | 0.077 | — | — | Remainder |
| 30 | 0.14 | 0.70 | 0.55 | 18.4 | 1.90 | 1.26 | 1.22 | 2.49 | 0.080 | — | — | Remainder |
| 31 | 0.15 | 0.68 | 0.52 | 18.1 | 1.87 | 1.29 | 1.18 | 1.53 | 0.052 | — | — | Remainder |
| 32 | 0.17 | 0.71 | 0.50 | 18.4 | 1.88 | 1.27 | 1.16 | 1.51 | 0.146 | — | — | Remainder |
| 33 | 0.16 | 0.74 | 0.49 | 18.2 | 1.89 | 1.28 | 1.15 | 1.58 | 0.089 | 0.22 | — | Remainder |
| 34 | 0.16 | 0.73 | 0.52 | 18.3 | 1.92 | 1.31 | 1.17 | 1.61 | 0.090 | 1.37 | — | Remainder |
| 35 | 0.17 | 0.72 | 0.53 | 18.3 | 1.93 | 1.34 | 1.19 | 1.59 | 0.086 | 2.48 | — | Remainder |
| 36 | 0.15 | 0.68 | 0.52 | 18.5 | 2.00 | 1.32 | 1.21 | 1.62 | 0.077 | — | 0.21 | Remainder |
| 37 | 0.14 | 0.70 | 0.56 | 18.7 | 2.01 | 1.34 | 1.20 | 1.57 | 0.078 | — | 1.32 | Remainder |
| 38 | 0.16 | 0.73 | 0.54 | 18.4 | 1.98 | 1.29 | 1.18 | 1.58 | 0.083 | — | 2.43 | Remainder |
| 39 | 0.15 | 0.70 | 0.50 | 18.1 | 1.97 | 1.25 | 1.19 | 1.63 | 0.081 | 0.64 | 0.51 | Remainder |

TABLE 6

| Classification | Component Composition (% by weight) | | | | | | | | | | | |
|---|---|---|---|---|---|---|---|---|---|---|---|---|
| | C | Si | Mn | Cr | Mo | Nb | Ta | Co | N | Ni | W | Fe + Impurities |
| Comparative Nozzles | | | | | | | | | | | | |
| 11 | 0.05* | 0.71 | 0.44 | 18.2 | 2.01 | 1.29 | 1.19 | 1.57 | 0.078 | — | — | Remainder |
| 12 | 0.27* | 0.69 | 0.42 | 18.0 | 1.98 | 1.31 | 1.18 | 1.59 | 0.080 | — | — | Remainder |
| 13 | 0.17 | 0.70 | 0.52 | 18.1 | 0.61* | 1.29 | 1.20 | 1.70 | 0.078 | — | — | Remainder |
| 14 | 0.18 | 0.72 | 0.53 | 18.3 | 3.03* | 1.30 | 1.17 | 1.73 | 0.079 | — | — | Remainder |
| 15 | 0.15 | 0.73 | 0.50 | 18.2 | 1.84 | 0.16* | 1.18 | 1.65 | 0.083 | — | — | Remainder |
| 16 | 0.13 | 0.75 | 0.49 | 18.4 | 1.83 | 2.54* | 1.22 | 1.62 | 0.086 | — | — | Remainder |
| 17 | 0.16 | 0.72 | 0.51 | 18.4 | 2.02 | 1.31 | 0.04* | 1.60 | 0.083 | — | — | Remainder |
| 18 | 0.17 | 0.70 | 0.50 | 18.3 | 2.00 | 1.26 | 2.72* | 1.63 | 0.081 | — | — | Remainder |
| 19 | 0.18 | 0.71 | 0.55 | 18.8 | 1.97 | 1.30 | 1.16 | 0.08* | 0.076 | — | — | Remainder |
| 20 | 0.18 | 0.69 | 0.55 | 18.9 | 1.95 | 1.30 | 1.15 | 2.85* | 0.077 | — | — | Remainder |
| 21 | 0.15 | 0.72 | 0.52 | 17.7 | 1.91 | 1.28 | 1.21 | 1.56 | 0.03* | — | — | Remainder |
| 22 | 0.13 | 0.73 | 0.48 | 17.9 | 1.89 | 1.26 | 1.22 | 1.55 | 0.21* | — | — | Remainder |

(Note: *indicates values outside the range of the present invention)

TABLE 7

| Classification | High Temperature Tensile Strength ($kgf/mm^2$) | Maximum Deformation (mm) | Maximum Crack Length (mm) | Classification | High Temperature Tensile Strength ($kgf/mm^2$) | Maximum Deformation (mm) | Maximum Crack Length (mm) |
|---|---|---|---|---|---|---|---|
| Nozzles of the Present Invention | | | | Nozzles of the Present Invention | | | |
| 16 | 7.25 | 0.04 | 0.3 | 25 | 6.08 | 0.11 | 0.6 |
| 17 | 7.12 | 0.06 | 0.5 | 26 | 7.88 | 0.03 | 0.9 |
| 18 | 7.50 | 0.05 | 1.0 | 27 | 6.29 | 0.11 | 0.6 |
| 19 | 7.15 | 0.07 | 0.5 | 28 | 7.72 | 0.03 | 0.8 |
| 20 | 7.42 | 0.05 | 0.9 | 29 | 6.64 | 0.08 | 0.6 |
| 21 | 7.30 | 0.06 | 0.5 | 30 | 7.52 | 0.03 | 0.4 |
| 22 | 7.22 | 0.06 | 0.9 | 31 | 6.71 | 0.08 | 0.5 |
| 23 | 6.23 | 0.10 | 0.7 | 32 | 7.70 | 0.03 | 0.8 |
| 24 | 7.75 | 0.03 | 0.8 | 33 | 7.35 | 0.03 | 0.3 |

TABLE 8

| Classification | High Temperature Tensile Strength (kgf/mm$^2$) | Maximum Deformation (mm) | Maximum Crack Length (mm) | Classification | High Temperature Tensile Strength (kgf/mm$^2$) | Maximum Deformation (mm) | Maximum Crack Length (mm) |
|---|---|---|---|---|---|---|---|
| Nozzles of the Present Invention | | | | Comparative Nozzles | | | |
| 34 | 7.58 | 0.03 | 0.3 | 14 | 8.11 | 0.03 | 2.1 |
| 35 | 7.95 | 0.02 | 0.8 | 15 | 5.76 | 0.26 | 0.8 |
| 36 | 7.41 | 0.03 | 0.3 | 16 | 8.01 | 0.02 | 2.7 |
| 37 | 7.79 | 0.02 | 0.6 | 17 | 6.09 | 0.21 | 0.6 |
| 38 | 8.05 | 0.02 | 1.1 | 18 | 7.89 | 0.02 | 2.4 |
| 39 | 7.52 | 0.02 | 0.5 | 19 | 5.53 | 0.24 | 0.7 |
| Comparative Nozzles | | | | 20 | 8.16 | 0.02 | 1.9 |
| | | | | 21 | 6.44 | 0.20 | 0.5 |
| 11 | 5.97 | 0.19 | 0.8 | 22 | 7.82 | 0.03 | 1.9 |
| 12 | 8.26 | 0.03 | 1.9 | | | | |
| 13 | 5.77 | 0.21 | 1.7 | | | | |

EXPERIMENTAL EXAMPLE 3

The nozzles 1~15 of the present invention, and comparative nozzles 1~10 used in Experimental Example 1 were installed into a 2,500 cc (exhaust amount) diesel engine, and actual mechanical tests were conducted under severe conditions by performing 4,000 cycles on each nozzle in which one cycle included a three minute stoppage after running the engine at 3,800 rpm for 2 minutes. Following .completion of the aforementioned test, the nozzle was removed and the maximum distortion amount (maximum projection amount) at the bottom face nozzle portion of the nozzle was measured by means of a surface roughness tester in order to evaluate the resistance to high-temperature deformation. In addition, in order to evaluate the thermal shock resistance, the maximum crack length of the bottom face nozzle portion of the nozzle was measured. The results of these measurements are shown in Table 8

As seen from the results shown in Table 9, even under the conditions of Experimental Example 3, nozzles 1~15 of the present invention each displayed superior characteristics with regard to high-temperature strength, resistance to high-temperature deformation, and thermal shock resistance. On the other hand, in the case of comparative nozzles 1~10 in which the content of one component comprising the Fe—Cr alloy was outside of the range specified according to the present invention, the aforementioned change resulted in the occurrence of one inferior characteristic among the high-temperature strength, resistance to high-temperature deformation, and thermal shock resistance.

TABLE 9

| Classification | Maximum Deformation (mm) | Maximum Crack Length (mm) | Classification | Maximum Deformation (mm) | Maximum Crack Length (mm) |
|---|---|---|---|---|---|
| Nozzles of the Present Invention | | | Nozzles of the Present Invention | | |
| 1 | 0.05 | 0.4 | 13 | 0.02 | 0.8 |
| 2 | 0.06 | 0.5 | 14 | 0.10 | 0.7 |
| 3 | 0.05 | 1.1 | 15 | 0.02 | 1.0 |
| 4 | 0.07 | 0.7 | Comparative Nozzles | | |
| 5 | 0.06 | 1.0 | | | |
| 6 | 0.05 | 0.5 | 1 | 0.28 | 1.4 |
| 7 | 0.06 | 1.1 | 2 | 0.07 | 2.8 |
| 8 | 0.10 | 0.6 | 3 | 0.34 | 1.8 |
| 9 | 0.04 | 0.8 | 4 | 0.05 | 3.2 |
| 10 | 0.12 | 0.7 | 5 | 0.41 | 1.6 |
| 11 | 0.02 | 1.0 | 6 | 0.04 | 3.6 |
| 12 | 0.11 | 0.7 | 7 | 0.36 | 1.2 |
| | | | 8 | 0.04 | 3.1 |
| | | | 9 | 0.25 | 0.7 |
| | | | 10 | 0.02 | 3.5 |

EXPERIMENTAL EXAMPLE 4

The nozzles 16~39 of the present invention, and comparative nozzles 11~22 used in Experimental Example 2 were installed into a 2,500 cc (exhaust amount) diesel engine, and actual mechanical tests were conducted under severe conditions by performing 4,500 cycles on each nozzle in which one cycle included a three minute stoppage after running the engine at 4,200 rpm for 2 minutes. Following Completion of the aforementioned test, the nozzle was removed and the maximum distortion amount (maximum projection amount) at the bottom face nozzle portion of the nozzle was measured by means of a surface roughness tester in order to evaluate the resistance to high-temperature deformation. In addition, in order to evaluate the thermal shock resistance, the maximum crack length of the bottom face nozzle portion of the nozzle was measured. The results of these measurements are shown in Tables 10 and 11.

As seen from the results shown in Tables 10 and 11, even under the conditions of Experimental Example 4, nozzles 16~39 of the present invention each displayed superior characteristics with regard to high-temperature strength, resistance to high-temperature deformation, and thermal shock resistance. On the other hand, in the case of comparative nozzles 11~22 in which the content of one component comprising the Fe—Cr alloy was outside of the range specified according to the present invention, the aforementioned change resulted in the occurrence of one inferior characteristic among the high-temperature strength, resistance to high-temperature deformation, and thermal shock resistance.

TABLE 10

| Classification | Maximum Deformation (mm) | Maximum Crack Length (mm) | Classification | Maximum Deformation (mm) | Maximum Crack Length (mm) |
|---|---|---|---|---|---|
| Nozzles of the Present Invention | | | Nozzles of the Present Invention | | |
| 16 | 0.05 | 0.4 | 25 | 0.13 | 0.7 |
| 17 | 0.07 | 0.6 | 26 | 0.03 | 1.1 |
| 18 | 0.06 | 1.2 | 27 | 0.13 | 0.7 |
| 19 | 0.08 | 0.6 | 28 | 0.04 | 1.0 |
| 20 | 0.06 | 1.1 | 29 | 0.10 | 0.7 |
| 21 | 0.07 | 0.6 | 30 | 0.04 | 0.5 |
| 22 | 0.07 | 1.1 | 31 | 0.10 | 0.6 |
| 23 | 0.12 | 0.8 | 32 | 0.04 | 1.0 |
| 24 | 0.04 | 1.0 | 33 | 0.04 | 0.4 |

TABLE 11

| Classification | Maximum Deformation (mm) | Maximum Crack Length (mm) | Classification | Maximum Deformation (mm) | Maximum Crack Length (mm) |
|---|---|---|---|---|---|
| Nozzles of the Present Invention | | | Comparative Nozzles | | |
| 34 | 0.04 | 0.4 | 14 | 0.04 | 2.4 |
| 35 | 0.02 | 1.0 | 15 | 0.31 | 1.0 |
| 36 | 0.04 | 0.4 | 16 | 0.02 | 3.2 |
| 37 | 0.02 | 0.7 | 17 | 0.25 | 0.7 |
| 38 | 0.02 | 1.3 | 18 | 0.03 | 2.9 |
| 39 | 0.03 | 0.6 | 19 | 0.29 | 0.8 |
| Comparative Nozzles | | | 20 | 0.02 | 2.3 |
| | | | 21 | 0.24 | 0.7 |
| 11 | 0.23 | 1.0 | 22 | 0.04 | 2.3 |
| 12 | 0.04 | 2.3 | | | |
| 13 | 0.25 | 2.0 | | | |

As described above, the Fe—Cr alloy and nozzle for diesel engines according to the present invention possess high-temperature characteristics superior to those of the conventional technology. For example, even when used in high performance and high output diesel engines under severe, high-temperature environments, the nozzles of the present invention display superior properties over an extremely long period.

What is claimed is:

1. Fe—Cr alloy consisting essentially of:

| | | | |
|---|---|---|---|
| C: | 0.1~0.2% by weight | Si: | 0.1~2% by weight |
| Mn: | 0.1~2% by weight | Cr: | 16~20% by weight |

-continued

| | | | |
|---|---|---|---|
| Mo: | 1.1~2.4% by weight | Nb: | 0.3~2.1% by weight |
| Ta: | 0.1~2.2% by weight | N: | 0.02~0.15% by weight |

with a remaining portion therein consisting of Fe and unavoidable impurities.

2. Fe—Cr alloy as recited in claim 1, wherein a portion of said Fe is substituted by means of 0.2~2.5% by weight of Co.

3. Fe—Cr alloy as recited in claim 1, wherein said contents of said Si and said Mn are Si: 0.4~1.2% by weight and Mn: 0.2~1% by weight, respectively.

4. Fe—Cr alloy as recited in claim 1, wherein a portion of said Fe is substituted by means of at least one element selected from the group consisting of 0.2~2.5% by weight of Ni and 0.2~2.5% by weight of W.

5. Fe—Cr alloy as recited in claim 2, wherein a portion of said Fe is substituted by means of at least one element selected from the group consisting of 0.2~2.5% by weight of Ni and 0.2~2.5% by weight of W.

6. Nozzle for diesel engines cast using an Fe—Cr alloy consisting essentially of:

| | | | |
|---|---|---|---|
| C: | 0.1~0.2% by weight | Si: | 0.1~2% by weight |
| Mn: | 0.1~2% by weight | Cr: | 16~20% by weight |
| Mo: | 1.1~2.4% by weight | Nb: | 0.3~2.1% by weight |
| Ta: | 0.1~2.2% by weight | N: | 0.02~0.15% by weight |

with a remaining portion therein consisting of Fe and unavoidable impurities.

7. Nozzle for diesel engines as recited in claim 6, wherein a portion of said Fe is substituted by means of 0.2~2.5% by weight of Co.

8. Nozzle for diesel engines as recited in claim 6, wherein said contents of said Si and said Mn are Si: 0.4~1.2% by weight and Mn: 0.2~1% by weight, respectively.

9. Nozzle for diesel engines as recited in claim 6, wherein a portion of said Fe is substituted by means of at least one element selected from the group consisting of 0.2~2.5% by weight of Ni and 0.2~2.5% by weight of W.

10. Nozzle for diesel engines as recited in claim 7, wherein a portion of said Fe is substituted by means of at least one element selected from the group consisting of 0.2~2.5% by weight of Ni and 0.2~2.5% by weight of W.

11. An Fe—Cr alloy consisting of:

C: 0.1–0.2% by weight;

Mn: 0.1–2% by weight;

Mo: 1.1–2.4% by weight;

Ta: 0.1–2.2% by weight;

Si: 0.1–2% by weight;

Cr: 16–20% by weight;

Nb: 0.3–2.1% by weight;

N: 0.02–0.15% by weight;

optionally 0.2–2.5% by weight of Co;

optionally 0.2–2.5% by weight of Ni;

optionally 0.2–2.5% by weight of W;

with a remaining portion therein consisting of Fe and unavoidable impurities.

12. A cast nozzle of an Fe—Cr alloy consisting of:

C: 0.1–0.2% by weight;

Mn: 0.1–2% by weight;

Mo: 1.1–2.4% by weight;

Ta: 0.1–2.2% by weight;

Si: 0.1–2% by weight;

Cr: 16–20% by weight;

Nb: 0.3–2.1% by weight;

N: 0.02–0.15% by weight;

optionally 0.2–2.5% by weight of Co;

optionally 0.2–2.5% by weight of Ni;

optionally 0.2–2.5% by weight of W;

with a remaining portion therein consisting of Fe and unavoidable impurities.

13. The alloy of claim 11, consisting of 0.2–2.5% by weight of Co.

14. The alloy of claim 11, consisting of 0.4–1.2% by weight of Si, and 0.2–1% by weight of Mn.

15. The alloy of claim 11, consisting of at least one member selected from the group consisting of 0.2–2.5% by weight of Ni and 0.2–2.5% by weight of W.

16. The alloy of claim 13, consisting of at least one member selected from the group consisting of 0.2–2.5% by weight of Ni and 0.2–2.5% by weight of W.

17. The nozzle of claim 12, wherein said alloy consists of 0.2–2.5% by weight of Co.

18. The nozzle of claim 12, wherein said alloy consists of 0.4–1.2% by weight of Si and 0.2–1% by weight of Mn.

19. The nozzle of claim 12, wherein said alloy consists of at least one member selected from the group consisting 0.2–2.5% by weight of Ni and 0.2–2.5% by weight of W.

20. The nozzle of claim 17, wherein said alloy consists of at least one member selected from the group consisting 0.2–2.5% by weight of Ni and 0.2–2.5% by weight of W.

* * * * *